United States Patent [19]

Bernstein

[11] 4,115,604

[45] Sep. 19, 1978

[54] ALUMINUM PLATING PROCESS

[75] Inventor: Max Jérémie Bernstein, Paris, France

[73] Assignee: Bremat S.A., Luxembourg, Luxembourg

[21] Appl. No.: 674,071

[22] Filed: Apr. 6, 1976

[30] Foreign Application Priority Data

Apr. 7, 1975 [LU] Luxembourg ..... 72235

[51] Int. Cl.[2] ..... C23C 1/02

[52] U.S. Cl. ..... 427/329; 427/345; 427/357; 427/374 C; 427/374 D; 427/406; 427/432; 428/646; 428/650; 428/658

[58] Field of Search ..... 427/405, 406, 374 C, 427/374 D, 118, 123, 329, 345, 357, 432; 29/194, 197; 75/178 R, 178 D, 178 T; 228/208

[56] References Cited

U.S. PATENT DOCUMENTS

| | | | |
|---|---|---|---|
| 1,233,803 | 7/1917 | Overend | 228/208 |
| 2,443,870 | 6/1948 | Reynolds | 228/208 |
| 3,525,598 | 8/1970 | Russell et al. | 29/197 |
| 3,681,019 | 8/1972 | Dean | 427/406 |
| 3,809,570 | 5/1974 | Herman | 427/374 D |
| 3,915,667 | 10/1974 | Ricks | 29/197 |

*Primary Examiner*—Ralph S. Kendall

[57] ABSTRACT

Delamination of plating on aluminum, for example tin plating, is avoided by providing an intermediate alloy coating on the aluminum prior to its passage through a bath of molten tin or a tin alloy. The coating is applied by passing cleansed aluminum through to the plating thereof with a primary protective metal. The intermediate alloy coating alloy contains zinc, bismuth, cadmium, tin and lead.

12 Claims, 1 Drawing Figure

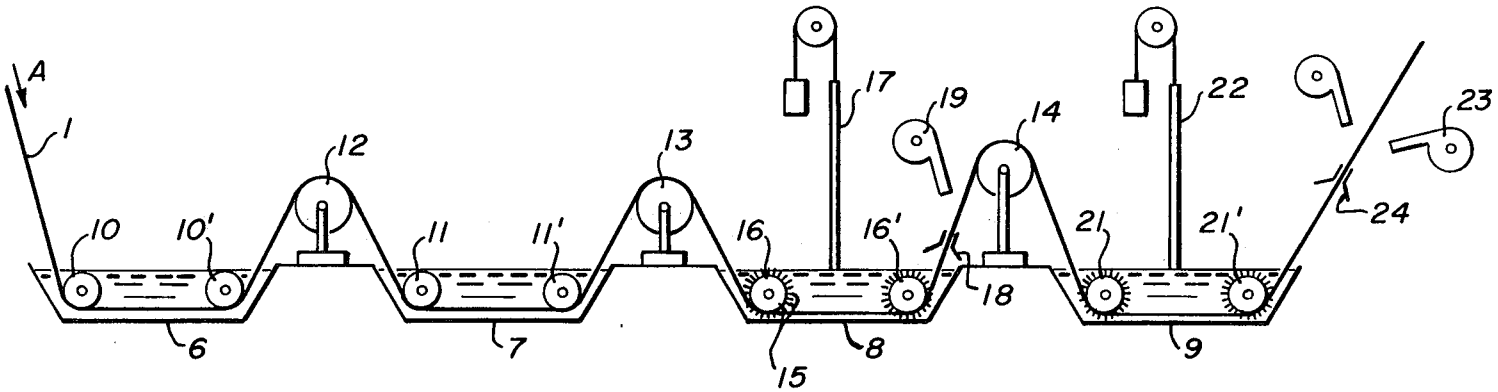
23
24
22
21'
9
21
14
18
19
16'
8
17
15
16
13
11'
7
11
12
10'
6
10
1
A

ALUMINUM PLATING PROCESS

BACKGROUND OF THE INVENTION (1) Field of the Invention

The present invention relates to the provision of an oxidation prevention coating on aluminum and particularly to the plating of aluminum. More specifically, this invention is directed to an intermediate alloy employed in the plating of aluminum and to apparatus for use in the hot and continuous plating of aluminum. Accordingly, the general objects of the present invention are to provide novel methods, materials and apparatus of such character.

(2) Description of the Prior Art

It is well known that, for many applications, aluminum can be substitued for copper. Because of the cost differential between aluminum and copper, such substitution is generally considered desirable. However, aluminum has the disadvantageous characteristic of being readily oxidizable. Accordingly, in order to enhance the utility of aluminum as a copper substitute, steps must be taken to reduce the oxidation thereof. The most commonly employed method of preventing oxidation of aluminum consists of plating with a layer of a material such as tin.

At the present time, electrolytic plating is the only process used with success for accomplishing a durable and effective bond between aluminum and tin or other oxidation preventing metal. However, taking energy consumption into account, electrolytic plating presents a serious financial inconvenience and in many cases the costs incident to electrolytic plating completely offset the economic advantages which would otherwise be gained from substitution of aluminum for copper.

Non-electrolytic processes for the hot and continuous plating of aluminum have been proposed and, in some cases, tested. Such continuous hot plating processes contemplate passing the aluminum through a molten bath of an oxidation preventing metal such as tin or a tin alloy. The previously proposed and tested continuous aluminum plating processes have afforded less than satisfactory results. Thus, the tin or other material plated onto aluminum during the previously attempted continuous hot plating processes has had a tendency to delaminate from the alumium.

SUMMARY OF THE INVENTION

The present invention overcomes the above briefly discussed and other disadvantages of the prior art by providing a novel hot plating process for aluminum which may be practiced continuously. The present invention also contemplates a plating system which may be employed in the practice of such novel process and a unique alloy which is utilized in such process. Thus, in accordance with the invention, an intermediate alloy layer is plated on aluminum, in a continuous process, before the application of tin, a tin alloy or some other equally suitable oxidation resistant metal. The intermediate plating alloy of the present invention comprises, in percents by weight, the following materials:

Zinc — Between 80 and 86%
Bismuth — Between 6 and 13%
Cadmium — Between 2 and 8%
Tin — Between 1 and 5%
lead — Between 0.1 and 1.5%

A plating system in accordance with the present invention, and for use in practice in the novel method of the invention, comprises at least four tanks through which the aluminum material or product will be serially passed. These tanks, in the order in which the goods to be plated are passed therethrough, contain a cleaning composition such as a caustic soda solution, a material for neutralizing the cleaning solution, the above described alloy which will be plated on the aluminum as an intermediate layer and a molten bath of the primary plating metal. When a caustic soda solution is employed or cleaning the aluminum to be plated, the neutralizing solution may comprise a nitric acid solution.

BRIEF DESCRIPTION OF THE FIGURE

The present invention may be better understood and its numerous objects and advantages will become apparent to those skilled in the art by reference to the accompanying drawing which is a schematic illustration of apparatus for use in practice of the present invention.

DESCRIPTION OF THE PREFERRED EMBODIMENT

As noted above, the present invention contemplates application of an intermediate alloy layer to aluminum prior to plating of the aluminum with a primary metal such as tin or a tin alloy. The material which comprises the intermediate alloy layer is characterized by good affinity for aluminum and for tin thus assuring an efficient and durable bond of the subsequently applied metal to the aluminum. In accordance with the preferred embodiment of the invention, this intermediate layer alloy embodiment of the invention, this intermediate layer alloy comprises, in percents by weight, the following materials:

Zinc — 83.5 to 84.5%
Bismuth — 9 to 10%
Cadmium — 4 to 5%
Tin — 2 to 3%
Lead — 0.1 to 0.8%

Zinc and bismuth are used in the alloy because of their good affinity for aluminum. Cadmium is incorporated in the alloy to lower the point of fusion thereof while the tin serves to equalize and homogenize the alloy.

The process in accordance with the present invention can be advantageously practiced in a plating system as shown schematically in the drawing. This plating system includes tanks 6, 7, 8 and 9 which are successively traversed by one or several objects or articles of aluminum such as the aluminum sheet indicated at 1. The aluminum sheets or articles to be plated are delivered to the plating apparatus, in the direction of arrow A, from one or several supply reels not shown on the drawing.

The tank 6 will be formed of or lined with a suitable plastic or an unoxidized steel. Tank 6 will contain cleansing solution as appropriate for aluminum. In accordance with a preferred embodiment of the invention, tank 6 will be filled with a solution of 15% caustic soda at room temperature. Two channeling pulleys 10 and 10', typically comprised of plastic, are immersed in tank 6 for each sheet of aluminum drawn through the tank; the channeling pulleys advancing and guiding the sheet 1 during its traverse of tank 6. The position of channeling pulleys 10 and 10' is preferably adjustable in the vertical direction.

The second successive tank 7 may also be lined with plastic or an unoxidizable steel. Tank 7 contains a material in liquid form suitable for neutralizing the cleansing solution applied to the aluminum in tank 6. In the case where the material in tank 6 is a 15% caustic soda solution, tank 7 will contain a 15% nitric acid solution which neutralizes the caustic soda. Tank 7 is also provided with a pair of channeling pulleys 11 and 11' for each of the parallelly disposed sheets of aluminum being drawn therethrough. The pairs of pulleys 11 and 11' cause the sheets of aluminum to advance through the tank while simultaneously guiding the sheets during traversal of the tank. A further pulley or drum 12 is positioned intermediate tanks 6 and 7. Pulley 12, which is preferably also comprised of an unoxidizable steel, will be mounted on bearings and will guide the sheets between tanks 6 and 7. As in the case of the channeling pulleys in tank 6, the pulleys 11 and 11' in tank 7 are preferably mounted on slides so that they can be displaced in a vertical direction.

The alloy which will be deposited on the aluminum as the intermediate layer is contained in tank 8 in molten form. Tank 8 thus includes a heating mechanism, not shown, which insures a regulated temperature for the molten intermediate layer alloy. The temperature within tank 8 may attain the level of 500° C. Tank 8 is also provided with pairs of channeling pulleys 16 and 16' for guiding the sheets of aluminum therethrough. The pulleys 16 and 16' are advantageously provided, at their peripheries, with blades or vanes 15 of heat resistant steel to assure continuous mixing of the alloy in the tank thereby assuring good homogeneity of the molten alloy.

In order to maintain a constant level in tank 8, molten alloy is continuously replenished as material is deposited on the aluminum passing through the tank. Replenishment of the alloy in tank 8 is accomplished through an automatic feed system, indicated schematically in the drawing, which includes a bar 17 of the intermediate alloy suspended above tank 8. Through the use of suitable control mechanisms, bar 17 will be fed into tank 8 to maintain the desired level therein thus achieving a continuous recharging of the tank while simultaneously avoiding a rapid drop of the temperature of the molten metal in tank 8 during the addition of material thereto.

It is possible, and in some cases may be desirable, to have means, not shown, associated with tank 8 for blowing carbonic gas over the surface of the molten alloy therein to avoid or reduce oxidation of the molten alloy.

At the exit of tank 8, the coated sheet 1 is passed between a pair of converging plates; i.e., a drawplate mechanism which has been indicated schematically at 18. The drawplate 18 will be formed of a very hard alloy, for example an alloy based on tungsten carbide, and will have an exit opening corresponding to the desired thickness of the coated sheet. Accordingly, the drawplate 18 will serve to wipe and calibrate the aluminum sheet with the coating or layer of intermediate alloy deposited thereon.

After passing through drawplate 18, the sheet 1 or other article comprised of aluminum will be cooled. The means for achieving this cooling is indicated schematically at 19 and can comprise means for generating a jet of atomized water or compressed air.

The plating with the primary metal is carried out in tank 9 which contains a bath of melted pure tin or a tin alloy. Tank 8 also contains vaned channeling pulleys 21 and 21' which are identical to the pulleys 16 and 16' in tank 8. An automatic replenishment system, which preferably feeds a bar 22 of the primary plating metal into tank 9, is also provided.

Between tanks 7 and 8, as well as between tanks 8 and 9, guiding pulleys respectively indicated at 13 and 14 are provided. It should be noted that the distance between tanks 8 and 9 is preferably larger than the distances separating the tanks 6 and 7 and the tanks 7 and 8; this additional distance being provided to insure sufficient cooling of the intermediate alloy layer prior to plating with the primary metal.

The sheet of plated aluminum exiting from the plating-tank 9 will traverse, successively, a drawplate mechanism 24 and a cooling apparatus 23 which are respectively similar to the drawplate 18 and the cooling device 19 associated with tank 8. After cooling, the plated aluminum article or articles exiting from tank 9 will typically be rolled onto drums or reels for storage.

A sheet of plated aluminum produced in accordance with the present invention can be drawn again if it should prove to be necessary to do so. However, such a plated sheet cannot be annealed since it is in effect a cold-rolled sheet. If reheating of the aluminum sheet after plating is required, it is necessary to initially start with a sheet of aluminum having a judiciously selected thickness.

As the result of the presence of the intermediate alloy layer, plated aluminum sheets prepared in accordance with the present invention may be subjected to various forces without delamination of the tin or tin alloy plating layer. Mechanical tests have been carried out on plated sheets produced in accordance with the invention and such tests have confirmed excellent results. Flexing and pulling tests have shown that the aluminum sheet will rupture without delamination of the tin plating.

Results of pulling tests are set forth below as carried out on three different thickness aluminum sheets which have been plated in accordance with the invenion:

| Sheet Number | Thickness | Pulling Strength (In Decanewtons) | Elastic Limit (In Decanewtons) |
|---|---|---|---|
| 1 | 2.54 | 37 | .6 |
| 2 | 2.40 | 36 | 15.0 |
| 3 | 2.14 | 33.6 | 14.6 |

For the three tests reported above, rupture of the aluminum sheet was produced without delamination of the tin plating.

The flexing tests to which plated sheets produced in accordance with the present invention have been subjected consisted of a helical rolling of a sheet on itself. Such flexing tests have not produced delamination.

It is known that plating of aluminum sheets permits the sheets to be welded to themselves or to other sheets prepared in the same manner. Accordingly, pulling tests have been performed on welded and plated sheets. These tests have also confirmed the good quality and solidity of the welds and have shown that ruptures of the sheets without delamination have occurred outside of the weld zones.

The plating system shown in the drawing is particularly well suited for plating several sheets in parallel. The sheets may be round, square or of any other desired cross-sectional shape. The plating system in accordance with the invention can equally be used for plating strips or plates of aluminum.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A process for the plating of an aluminum substrate comprising the steps of:

cleaning the substrate;

coating the cleansed substrate with a layer of an intermediate alloy comprising, by weight, 80 to 86% zinc, 6 to 13% bismuth, 2 to 8% cadmium, 1 to 5% tin and 0.1 to 1.5% lead by passing the substrate through a molten bath of the intermediate alloy; and plating an oxidation resistant metal having a fusion point which does not exceed that of tin and its alloys over the intermediate alloy layer by passing the coated substrate through a bath containing the oxidation resistant metal in molten form.

2. The method of claim 1 wherein the step of coating comprises:

forming an alloy comprising zinc, bismuth, cadmium, tin and lead; and passing the cleansed aluminum substrate through a bath of the molten alloy.

3. The method of claim 2 wherein the step of forming the intermediate alloy comprises:

producing a metal comprising, in percent by weight, zinc = 83.5 to 84.5% bismuth = 9 to 10% cadmium = 4 to 5% tin = 2 to 3% lead = 0.1 to 0.8%.

4. The method of claim 3 wherein the step of plating comprises:

depositing a coating containing tin over the intermediate alloy layer.

5. The method of claim 2 wherein the step of cleaning the aluminum substrate comprises:

drawing the substrate through a cleansing solution; and neutralizing the cleansing solution remaining on the surface of the substrate subsequent to removal from the cleansing solution.

6. The method of claim 5 wherein the steps of drawing through a cleaning solution, neutralizing, coating with the intermediate alloy and plating are performed continuously.

7. The method of claim 6 wherein the step of coating with the intermediate alloy further comprises:

maintaining the temperature of the molten alloy while the aluminum substrate to be plated is passed therethrough; and maintaining the level of the molten alloy in the bath.

8. The method of claim 7 further comprising the steps of:

cooling the coated aluminum substrate prior to plating; and cooling the plated aluminum substrate.

9. The method of claim 8 wherein the step of plating comprises:

depositing a coating containing tin over the intermediate alloy layer.

10. The method of claim 2 wherein the step of coating with the intermediate alloy further comprises:

maintaining the temperature of the molten alloy while the aluminum substrate to be plated is passed therethrough; and maintaining the level of the molten alloy in the bath.

11. The method of claim 2 further comprising the steps of:

cooling the coated aluminum substrate prior to plating; and cooling the plated aluminum substrate.

12. The method of claim 1 wherein the step of plating comprises:

depositing a coating containing tin over the intermediate alloy layer.

* * * * *